United States Patent [19]

Fischer et al.

[11] Patent Number: 4,574,821

[45] Date of Patent: Mar. 11, 1986

[54] EXPANDED WRAPPER AND SMOKING ARTICLES INCLUDING SAME

[75] Inventors: Eugene B. Fischer, Chester; A. Clifton Lilly, Richmond, both of Va.

[73] Assignee: Philip Morris Incorporated, New York, N.Y.

[21] Appl. No.: 592,070

[22] Filed: Mar. 22, 1984

[51] Int. Cl.[4] ..... A24D 1/02

[52] U.S. Cl. ..... 131/365; 131/358; 131/360

[58] Field of Search ..... 131/62, 365, 358, 360

[56] References Cited

U.S. PATENT DOCUMENTS

| | | | |
|---|---|---|---|
| 2,462,446 | 2/1949 | Wellborn | 131/339 |
| 2,936,764 | 5/1960 | van Tuyl | 131/339 |
| 3,220,418 | 11/1965 | Cohn | 131/339 |
| 3,490,461 | 1/1970 | Osmalov et al. | 131/339 |
| 3,516,417 | 1/1970 | Moses | 131/339 |
| 3,518,921 | 7/1970 | Muller | 131/339 |
| 3,596,663 | 8/1971 | Schultz | 131/339 |
| 3,700,522 | 10/1972 | Wonderly | 131/339 |
| 3,773,053 | 11/1973 | Stephens, Jr. | 131/339 |
| 3,910,287 | 10/1975 | Walton | 131/339 |
| 4,109,665 | 8/1978 | Godfrey, Jr. et al. | 131/339 |
| 4,168,712 | 9/1979 | Labbe | 131/365 |
| 4,291,711 | 9/1981 | Berger | 131/339 |
| 4,459,998 | 7/1984 | Labbe et al. | 131/62 |

FOREIGN PATENT DOCUMENTS

| | | |
|---|---|---|
| 864247 | 3/1961 | United Kingdom . |
| 1087453 | 10/1967 | United Kingdom . |
| 1277449 | 6/1972 | United Kingdom . |
| 1531463 | 11/1978 | United Kingdom . |
| 2069310 | 8/1981 | United Kingdom . |
| 2119628 | 11/1983 | United Kingdom . |

*Primary Examiner*—V. Millin

[57] ABSTRACT

An expanded wrapper is provided which includes a flexible layer of sheet material with stiffening means attached to a surface of the sheet material. The expanded wrapper can be used in the fabrication of smoking articles thus providing an article in which the resulting firmness and rigidity can be made independent of the density of the smoking material.

18 Claims, 7 Drawing Figures

EXPANDED WRAPPER AND SMOKING ARTICLES INCLUDING SAME

FIELD OF THE INVENTION

This invention relates to wrappers for smoking articles, such as cigarettes, and more particularly, to an expanded wrapper, and smoking articles including such wrappers.

BACKGROUND OF THE INVENTION

In manufacturing mass produced cigarettes, it is important to maintain various parameters constant from cigarette to cigarette so that one cigarette is virtually identical to the next. One of the characteristics closely controlled in cigarettes is density of the tobacco rod. Density of the rod is important for several reasons, one of which is that it affects the smoking characteristics of the cigarette. Another reason is that a cigarette which is not dense enough will not be firm and will tend to deform in the hand of the smoker.

The density of the tobacco in a cigarette has been associated, in general, with the firmness characteristics of the cigarette because the conventional cigarette wrapper has little structural strength and serves mainly to contain the rod of tobacco. Thus, the cigarette rod owes its structural strength and firmness almost entirely to the density of the tobacco in the rod. A conventional cigarette has a rod of compacted tobacco shreds surrounded by a very thin paper wrapper. Its rigidity and firmness are largely dependent on density of the rod. To use a less dense rod is not practical because the cut tobacco filler of the cigarette would not stay together, and to make the paper wrapper thicker and stronger still would not keep the tobacco from falling out if it were more loosely packaged.

Accordingly, there exists in the art a need for a wrapper which when used in the manufacture of smoking articles such as cigarettes, provides a smoking article in which structural rigidity is relatively independent of the density of the tobacco.

SUMMARY OF THE INVENTION

According to the present invention, an expanded wrapper is provided which is a thin flexible layer of sheet material with stiffening means attached to a surface of the sheet material. Preferably, the expanded wrapper includes spaced inner and outer layers of sheet material with the stiffening means located between the two layers. The stiffening means may be joined to one or both of the spaced inner and outer layers of sheet material. The composite wrapper provides a structure in which the resulting firmness and rigidity of cigarettes made from the expanded wrapper can be made independent of the density of the smoking material. Preferably, the stiffening means is a cellular structure such as a honeycomb structure. In one embodiment of the present invention, the tobacco rod can be replaced by an extruded rod of smoking material with the expanded wrapper of the present invention surrounding and supporting the extruded rod to achieve firmness and rigidity independent of the density of the extruded rod.

DESCRIPTION OF THE PREFERRED EMBODIMENTS

Figure 1:
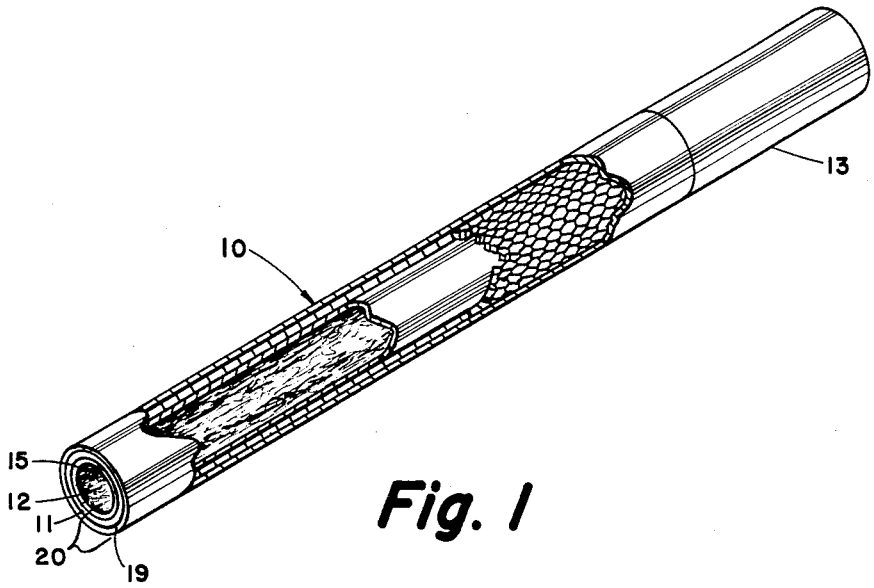
FIG. 1 is a perspective view, partially cut away, of a first embodiment of a cigarette of the present invention.

Referring now to the drawings and more particularly to FIG. 1, there is illustrated an embodiment of the present invention; a cigarette designated generally by the numeral 10. Cigarette 10 includes a column of cut tobacco filler 12 enclosed by an expanded cigarette wrapper 20. A filter 13 is attached in conventional manner.

Expanded wrapper 20 includes, as stiffening means, a honeycomb structure 11, sandwiched between two layers of conventional cigarette paper 19 and 15. The inner layer 15 may serve to prevent shreds of tobacco in rod 12 from escaping into the open spaces formed by the cells of the honeycomb. The outer layer 19 is desirable for the sake of appearance. The inner layer 15 and outer layer 19, together with honeycomb 11, form an expanded wrapper 20 of greater structural strength than a conventional wrapper.

Either the inner layer 15 or the outer layer 19 may be omitted from the expanded wrapper structure. If the inner layer 15 is omitted, the stiffening means 11, here illustrated as a honeycomb structure, will present an open cellular inner surface to the cut tobacco filler 12. Strands of the filler may extend into the interstices of honeycomb 11 and so assist in holding the filler in the wrapper.

The expanded wrapper 20 may be formed as follows. Glue lines are placed on a sheet of cigarette paper, in parallel lines, a fixed distance apart. A second sheet of cigarette paper is placed on top of the glue lines on the first sheet of paper. Additional glue lines are placed on the second sheet, parallel to the glue lines on the first sheet, but such that the glue lines on the second sheet lie approximately halfway between the glue lines on the first sheet. A third sheet of paper is placed on the second sheet and glue lines are placed on the third sheet directly above the glue lines on the first sheet, but midway between the glue lines on the second sheet. Additional sheets and glue lines are built up in like manner.

When a stack of suitable height is achieved, one edge of the stack is cut off perpendicular to the glue lines. The width of the cut is equal to the desired thickness of the honeycomb structure. This piece of the stack that is cut off is then converted into a honeycomb structure by pulling the first sheet placed in the stack away from the last sheet placed in the stack, thus forming an expanded honeycomb structure having its cell walls attached at the glue lines.

The foregoing method of construction is adaptable to automated processes. Moreover, the invention is not limited to any particular means of creating the cellular stiffening structure.

Due to the thickness of the honeycomb structure 11, given a particular outside diameter of the cigarette, the amount of tobacco required for column 12 is reduced. Employing the expanded wrapper, cigarettes can be manufactured which contain from about 200 to about 1000 mg of tobacco and have a circumference of from about 22 to about 25 mm and a rod length of from about 50 to about 100 mm. Thus, the thickness of the honeycomb 11 can be regulated within certain bounds. As the thickness of the cellular structure increases, excessive displacement of tobacco may occur. As the thickness decreases, a thickness will be reached at which the composite wrapper will not produce the structural rigidity necessary to achieve the desired firmness of the cigarette. For optimum performance, the expanded wrapper including the cellular structure 11 should be between 1 mm and 3 mm thick for a cigarette having a circumference of from about 22 to about 25 mm and the cell size should be from about 1 to about 3 mm in diameter. The expanded wrapper can have a thickness equal to one-half the diameter of the cigarette where it is desired to manufacture a cigarette which does not include a core of a conventional smoking material such as tobacco. The expanded wrapper, when incorporated in the manufacture of a cigarette, should result in a cigarette having a firmness value within the range of from about 0.5 $mm \times 10^{-1}$ to approximately 1.0 $mm \times 10^{-1}$.

Figure 2:
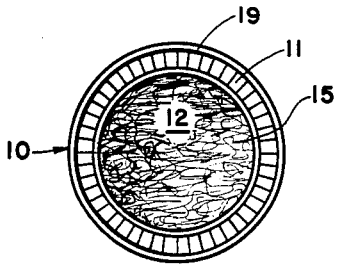
FIG. 2 is a cross section perpendicular to the longitudinal axis of the cigarette shown in FIG. 1.

Although the cross-section of the cigarette shown in FIG. 2 is approximately circular, an expanded wrapper according to the present invention is suitable for making cigarettes of a shape other than circular. For example, the expanded wrapper of the present invention may be used in the manufacture of cigarettes which have an oval cross-section, a square cross-section, or various other geometric shapes.

Although the stiffening means shown in the embodiments discussed thus far has been a honeycomb structure, any suitable structure having sufficient flexibility to be formed into a cigarette wrapper may be used. One alternative to the honeycomb structure employs a paper-like sheet material thicker than ordinary cigarette paper, but having regular, discrete openings, such as circles or squares or triangles punched out of the sheet, in order to lower its density and increase its radial porosity in the finished cigarette. Another alternative is a relatively thick, paper-like sheet material inherently more porous than conventional cigarette paper, either with or without openings cut into the material. Either of these variations may be combined with an inner or outer facing sheet, or both, made of conventional cigarette paper.

Material used to form the cellular structure may be any type of flexible sheet, whether combustible or not. The same paper that is used for conventional cigarette wrappers may be used in the formation of the cellular structure, or other materials of choice to suit a particular cigarette design may be used. Additionally, reconstituted tobacco, which is made by a papermaking process, may be used to form the cellular structure, or either or both of the facing sheets of the expanded wrapper, in order to achieve burn characteristics similar to those of the tobacco column.

Material suitable for use in tobacco column 12 is not limited to cut tobacco filler. Any suitable smoking material such as expanded tobacco or various substitute tobacco-like materials known in the art may be used.

The flow of gases through the expanded wrapper in a direction parallel to the longitudinal axis of the cigarette is preferably limited. Allowing smoke or air to flow through the wrapper along the axial direction can alter the smoking characteristics and the flavor of the cigarette. The materials employed in the manufacture of the stiffening means and the inner and outer layers may be selected to achieve a desired porosity in the radial direction, or porosity may be selected by the use of perforations as is conventionally practiced in the art of cigarette design. Preferably, when cigarette paper is employed as the outer layer, the cigarette paper will have a porosity of from about 8 to about 30 sec.

In the embodiments shown in the figures which include a honeycomb structure, the honeycomb structure has essentially non-interconnecting hollow cells. These cells may be filled with various suitable substances, such as menthol or other flavorants, or a compatible filler material. Applying volatile materials such as menthol has traditionally presented problems due to their volatility and tendency to migrate. Menthol or another flavoring may be applied to or within the honeycomb structure prior to covering the honeycomb structure with inner and outer layers or it may be encapsulated into the material used to make the honeycomb structure.

Figure 3:
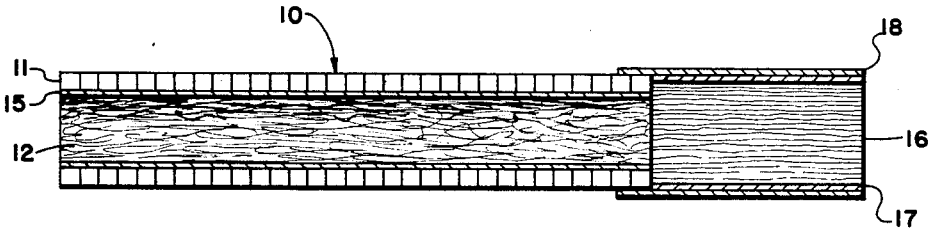
FIG. 3 is a longitudinal cross section of a second embodiment of a cigarette of the present invention.

FIG. 3 shows an embodiment of the present invention in which inner layer 15 encloses tobacco column 12, and in turn is enclosed by honeycomb structure 11. In this embodiment an outer layer is not employed. This embodiment may be used to give the cigarette an appearance which may appeal to certain market segments.

Figure 3A:
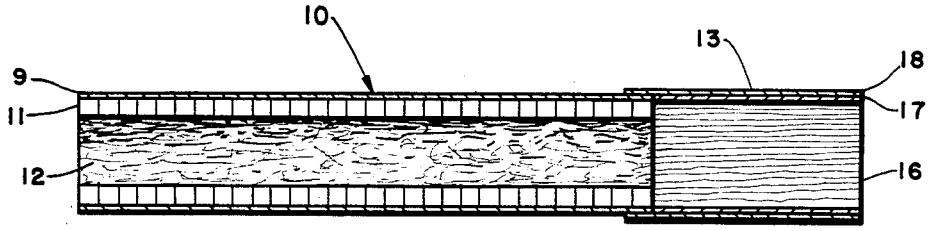
FIG. 3*a* is a longitudinal cross section of a third embodiment of a cigarette of the present invention.

FIG. 3*a* shows yet another embodiment of the present invention in which expanded wrapper 11 encloses tobacco column 12 which is, in turn, enclosed by outer layer 19. The honeycomb structure has a cell size small enough to prevent most tobacco shreds from migrating into the honeycomb cells. This embodiment employs a lower total weight of paper than an expanded wrapper including an inner and an outer layer and a honeycomb layer sandwiched therebetween. Filter 13 is made of a conventional cellulose acetate material 16 enclosed in a porous plug wrap 17 and attached to the cigarette rod by tipping paper 18.

Figure 4:
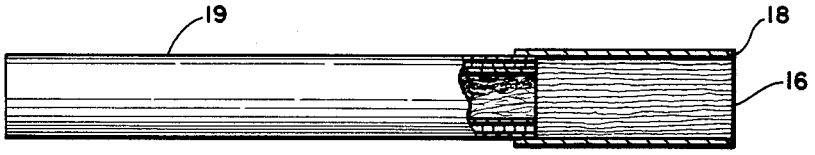
FIG. 4 is a partial longitudinal cross section of the cigarette shown in FIG. 1.
Figure 5:
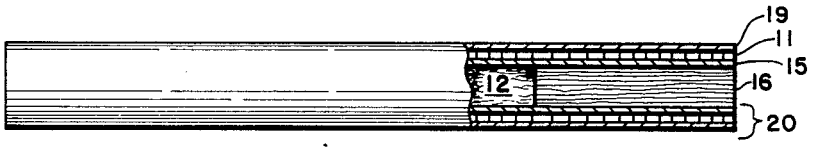
FIG. 5 is a partial longitudinal cross section of a fourth embodiment of a cigarette of the present invention.
Figure 6:
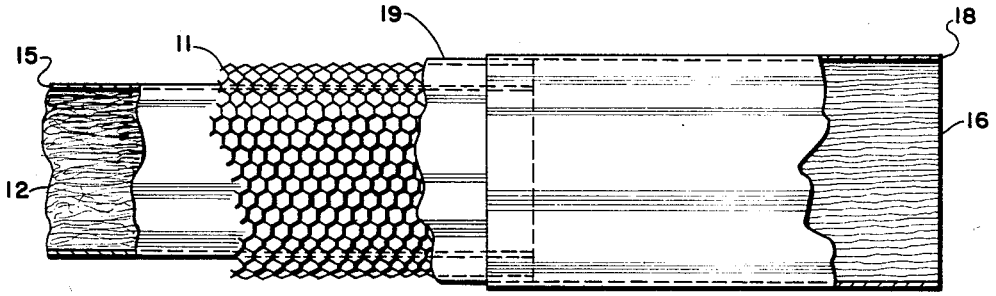
FIG. 6 is a partial longitudinal cross section of the cigarette shown in FIG. 1.

In FIG. 4, a non-wrapped acetate filter 21 is attached to outer layer 19 of the cigarette by tipping paper 18. FIG. 5 shows filter 21 joined to the tobacco column 12 by a continuous expanded wrapper 20 having inner layer 15, honeycomb 11, and outer layer 19. FIG. 6 shows the various layers of expanded wrapper 20.

EXAMPLE

Expanded wrappers illustrative of the present invention were made as described above, employing the specific parameters set forth below. The glue lines were placed on each sheet about 5.5 mm apart. A stack of sheets was built up to a height of 42 sheets. An edge portion about 1.0 mm wide was cut from the stack and expanded so that the height of the honeycomb structure was about 40 mm. Two sheets of conventional cigarette paper were glued to the honeycomb structure, one on each side. The adhesive used was polyvinyl acetate solution. The approximate cell size of the honeycomb was about 3 mm.

Five cigarettes were made by hand using this expanded wrapper. The final cigarettes were approximately 8 mm in diameter and 60 mm in length exclusive of the filter. A conventional filter of cellulose acetate, 25 mm in length was attached in a conventional manner. The values that appear in the data tabulated below are average values. The data appearing under the column headed conventional cigarettes is comparative and the values are typical values for cigarettes manufactured in a conventional manner without an expanded wrapper but having the same overall dimensions as the cigarettes of the present invention employed in this example.

| Characteristics | Conventional Cigarette | Cigarette With Expanded Wrapper |
|---|---|---|
| Amount of Tobacco Used (mg) | 800 | 420 |
| RTD* (inches/$H_2O$) | 4.5–4.7 | 4.25 |
| Firmness** (mm) | $2.0 \times 10^{-1}$–$5.0 \times 10^{-1}$ | $.5 \times 10^{-1}$–$1.0 \times 10^{-1}$ |
| Circumference | 24.8–25.0 | 24.7 |

*Resistance to draw (RTD) is defined as the pressure developed across the full length of a cirgarette, in inches of water, when air is pulled through it at the rate of 1,050 cubic centimeters per minute.

**Firmness is measured by applying a pressure of 300 grams across the diameter of a cigarette, then measuring the deformation in millimeters. The compressive load is applied through a fixed-area shoe and the load maintained through a 15 second measurement period.

When the cigarettes of the present invention were smoked, they were determined to have subjective characteristics similar to conventional cigarettes and to have the same RTD even though the cigarettes of the present invention had one-half the weight and twice the firmness of the conventional cigarettes.

What is claimed is:

1. An expanded wrapper for use in the fabrication of smoking articles, comprising a layer of sheet material and cellular stiffening means attached to a surface of the sheet material, the wrapper being substantially impermeable to gas flow in a longitudinal direction.

2. The wrapper of claim 1, including a second layer of sheet material spaced from the other layer of sheet material, wherein the cellular stiffening means is between the two layers.

3. The wrapper of claim 1 or 2 wherein the expanded wrapper is radially gas permeable.

4. The wrapper of claim 1 wherein the cellular stiffening means is a honeycomb structure.

5. The wrapper of claim 1 wherein the cellular stiffening means encapsulates a flavoring material.

6. The wrapper of claim 1 wherein the wrapper is between 1 and 3 mm thick.

7. The wrapper of claim 1 wherein the wrapper comprises cigarette paper.

8. The wrapper of claim 1 wherein the wrapper comprises reconstituted tobacco.

9. A smoking article, comprising:

a column of smoking material;

an expanded wrapper enclosing the column, the wrapper comprising a layer of sheet material and cellular stiffening means attached to the surface of the sheet material, which cellular stiffening means substantially precludes gas flow longitudinally through the wrapper.

10. The smoking article of claim 9 wherein the wrapper is radially gas permeable.

11. The smoking article of claim 9 wherein the cellular stiffening means is a honeycomb structure and the expanded wrapper includes an outer layer of sheet material and an inner layer of sheet material on either side of the honeycomb structure.

12. The smoking article of claim 11 wherein the honeycomb has a cell size of from about 1 mm to about 3 mm in diameter.

13. The smoking article of claim 9 wherein the cellular stiffening means is a honeycomb structure and the wrapper includes an inner layer of sheet material.

14. The smoking article of claim 9 wherein the cellular stiffening means is a honeycomb structure and the wrapper includes an outer layer of sheet material.

15. The smoking article of claim 9 wherein the wrapper contains flavoring material.

16. The smoking article of claim 9 wherein the wrapper is between about 1 and 3 mm thick.

17. The smoking article of claim 9 wherein the wrapper comprises cigarette paper.

18. The smoking article of claim 9 wherein the wrapper comprises reconstituted tobacco.

* * * * *